US007192082B2

(12) United States Patent
Tennian

(10) Patent No.: US 7,192,082 B2
(45) Date of Patent: Mar. 20, 2007

(54) PORTABLE BENCH

(76) Inventor: Thomas H. Tennian, 2169 Rushton Road, Ottawa, ON (CA) K2A 1N6

( * ) Notice: Subject to any disclaimer, the term of this patent is extended or adjusted under 35 U.S.C. 154(b) by 312 days.

(21) Appl. No.: 10/923,311

(22) Filed: Aug. 23, 2004

(65) Prior Publication Data

US 2006/0103176 A1 May 18, 2006

(51) Int. Cl.
*A47C 4/00* (2006.01)

(52) U.S. Cl. ..... 297/16.1; 108/90; 108/157.16; 297/175; 297/440.1

(58) Field of Classification Search ..... 297/16.1, 297/175, 179, 440.1, 440.2; 108/42, 83, 108/90, 157.1, 157.16
See application file for complete search history.

(56) References Cited

U.S. PATENT DOCUMENTS 955,804 A * 4/1910 Hyde ..... 108/90
1,413,111 A * 4/1922 Fricker ..... 108/90
1,888,478 A * 4/1932 Steidl ..... 108/136
1,886,806 A * 11/1932 Hanley ..... 108/90
2,468,962 A * 5/1949 Czak ..... 108/90
2,508,627 A * 5/1950 Spiegel et al. ..... 108/19
4,436,340 A * 3/1984 Hernandez ..... 297/188.09
4,760,802 A * 8/1988 Leong ..... 108/157.16
4,846,076 A * 7/1989 Menges et al. ..... 297/188.09
5,819,671 A * 10/1998 Ocampo ..... 108/64

* cited by examiner

*Primary Examiner*—Peter R. Brown
(74) *Attorney, Agent, or Firm*—David J. French

(57) ABSTRACT

A portable seating device is provided in the form of at least two horizontal planks having respective coupling ends along which such members may be joined. The underside surfaces of these planks are provided with vertical support containment means. Such vertical support containment means serve to contain and localize the upper end of a central vertical support placed against the underside surfaces of the two horizontal seating members, overlapping their connected coupling ends. A preferred central vertical support is a tapered pail or bucket which may or may not have its carrying handle removed.

Additional vertical supports may be provided to underlie further portions of the underside surfaces of the horizontal planks, deployed symmetrically on either side of the central vertical support and similarly localized against the underside surfaces.

7 Claims, 3 Drawing Sheets

PORTABLE BENCH

FIELD OF THE INVENTION

This invention relates to a seating device. More particularly, it relates to a portable seating device in the form of a bench.

BACKGROUND TO THE INVENTION

Numerous designs for seating devices have been created over time. However, the need for a convenient portable seating device, particularly one in the form of a bench persists.

When sports or competitive games are played in fields by youth and amateur teams, they are usually played in fields that do not contain seating for the players that are not actively involved in the game or spectator seating. A need exists, therefore, for an easily portable and cost effective means for seating a group of people. Amongst other characteristics, such a device should be readily portable, fully stable, comfortable and preferably have a low-cost. This invention addresses such a device.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to the present invention, in one aspect a portable seating device is provided in the form of at least two horizontal seating members having respective coupling ends along which such members may be joined. These horizontal seating members may be in the form of wooden boards, molded plastic plates or equivalent, dimensioned to serve as seats. Such horizontal seating members each respectively have an upper, seating, surface, and an underside surface. The upper seating side of the horizontal sections is to be either flat or, optionally, grooved to provide a more comfortable seat. The seating side can also optionally be covered with a padded layer to increase comfort.

The coupling ends of these respective horizontal seating members may be connected through a hinge, or be otherwise connectable to provide an extended seating surface provided by both horizontal members. Further, such coupling ends also permit the two horizontal seating members to be positioned such that they lie adjacent to each other for ready transportation.

On the underside surface of each horizontal seating member, proximate to its respective coupling ends, is provided a vertical support containment means. Such vertical support containment means may be in the form of grooves, posts, rails, rail segments or other equivalents structures which will localize the upper end of a central vertical support placed against the underside surfaces of the two horizontal seating members, overlapping their connected coupling ends.

Said vertical support should preferably have a base designed such that the system does not sink into soft ground, damaging the terrain and decreasing the comfort of the users. A preferred shape for these supports, therefore, is generally that of a cylinder. Other shapes, such as prisms or truncated cones can be used as long as their size, shape and degree of taper do not interfere with the normal operation of the system.

The central vertical support preferably has a generally cylindrical form which extends from a base rim at one end upwardly to a seat-engaging end that abuts against portions of the underside surfaces of both of the horizontal seating members. Preferably, this central vertical support may have the cross-section of a right circular cylinder, but may also depart from being circular in cross-section. The central vertical support need not be perfectly cylindrical, but may incorporate a degree of taper which does not interfere with its support function. The preferred, convenient form of the central vertical support is that of a hollow truncated right circular cone. By using truncated right circular cones such as buckets or pails, which may or may not have handles, the supports can be nested into each other for easy transportation.

The wall of the central vertical support may be solid or perforated to a degree which, as well, does not interfere with its support function. The core of the central vertical support is preferably hollow.

According to a further variant of the invention, one or more, preferably two, additional, similar, vertical supports may be provided to underlie further portions of the underside surfaces of the horizontal seating members. Preferably but not necessarily, such additional vertical supports are deployed symmetrically on either side of the central vertical support. According to such variants, additional vertical support containment means are provided on the underside surfaces of the horizontal seating members to localize the additional vertical supports in position when they are deployed for seating.

All of the vertical supports should be disconnectable from the horizontal seating support members. By choosing tapered pails or equivalent as the vertical supports, such pails may be easily disengaged from the underside of the horizontal seating support members and then nested within each other for compact transportation.

In addition to the use of multiple vertical supports, more than two horizontal seating members can be employed. Thus the bench according to the invention may be extended by additional horizontal seating members, each provided with coupling means to join them to an adjacent seating member. Correspondingly, additional vertical support members can be positioned in the similar manner to that of the primary, central support member and the further vertical support members as described above.

As a further option, one of the horizontal seating members may be provided towards one of its two ends with one or more wheels that extend downwardly or outwardly from its underside surface at locations which will not interfere with the fitting of a vertical support member in position when the combination is to serve as a bench. Such wheels should not only be outwardly spaced from a vertical support, but should extend downwardly from the underside surface of the horizontal seating members only by an amount which is less than the height of a vertical support.

At the opposite and of the horizontal seating member carrying wheels, a strap, rope, carved handle of other means of pulling the device may be attached allowing the folded assembly to be trailered manually. Additionally, a hook, pin or other means of engaging a handle may be provided on the underside of the other horizontal seating member for engagement with the handles of the buckets. To further fix the assembly of buckets to the folded bench, a flexible strap may extend outwardly from one of the horizontal seating members to embrace and anchor the assembly of buckets.

Accordingly, the invention provides a low-cost portable bench system which may be deployed by placing the vertical supports on the ground, aligned for engagement by the containment means on the respective underside surfaces of the horizontal seating members. The joining of such members along their connecting ends serves to complete the containment of the central vertical support and provide a an extended seating surface.

The foregoing summarizes the principal features of the invention and some of its optional aspects. The invention may be further understood by the description of the preferred embodiments, in conjunction with the drawings, which now follow.

BRIEF DESCRIPTION OF THE DRAWINGS

FIG. 3 is a side view along the long axis of the deployed seating system with optional additional supports in position to.

DESCRIPTION OF THE PREFERRED EMBODIMENT

Figure 1:
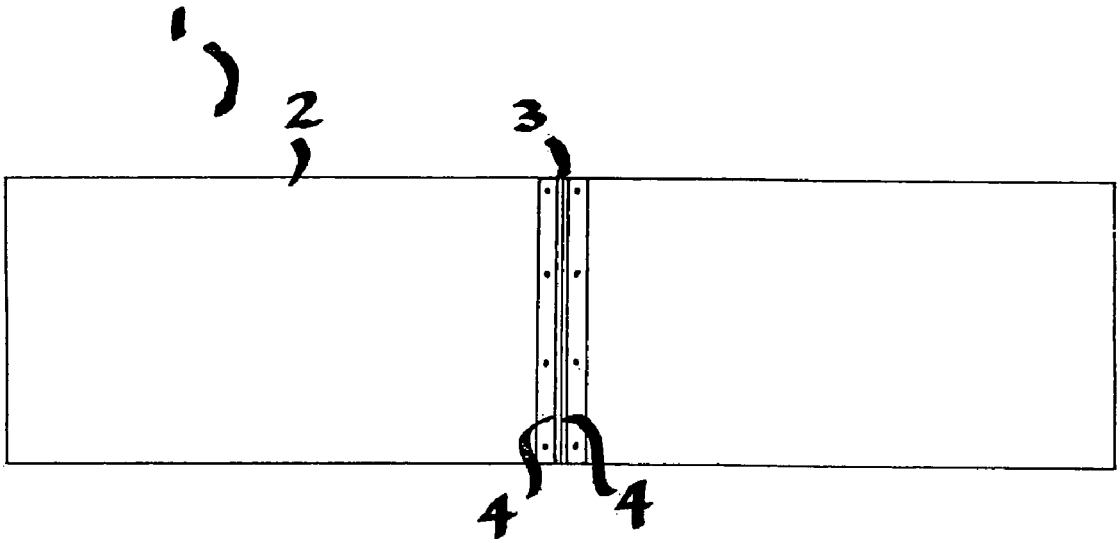
FIG. 1 is a top view of the deployed seating system.

With reference now to the drawings, and in particular to FIG. 1 thereof, the preferred embodiment of the new and improved portable seating system 1 includes at least two horizontal seating members 2 having respective coupling ends 4 along which the support members 2 are joined. Such horizontal seating members 2 each respectively have an upper, seating, surface 16, and an underside surface 17.

Figure 4:
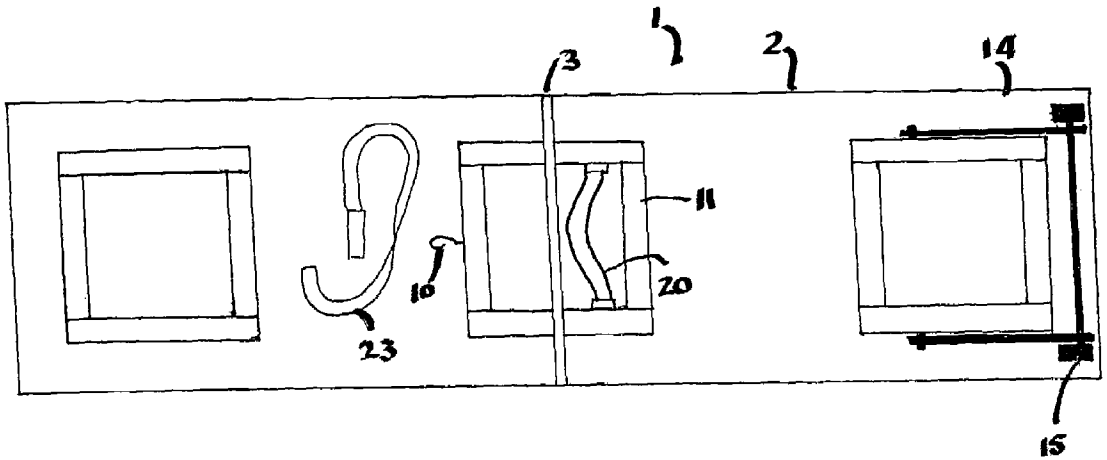
FIG. 4 is a bottom view of the deployed seating system with the vertical supports removed to expose the containment means.
Figure 5:
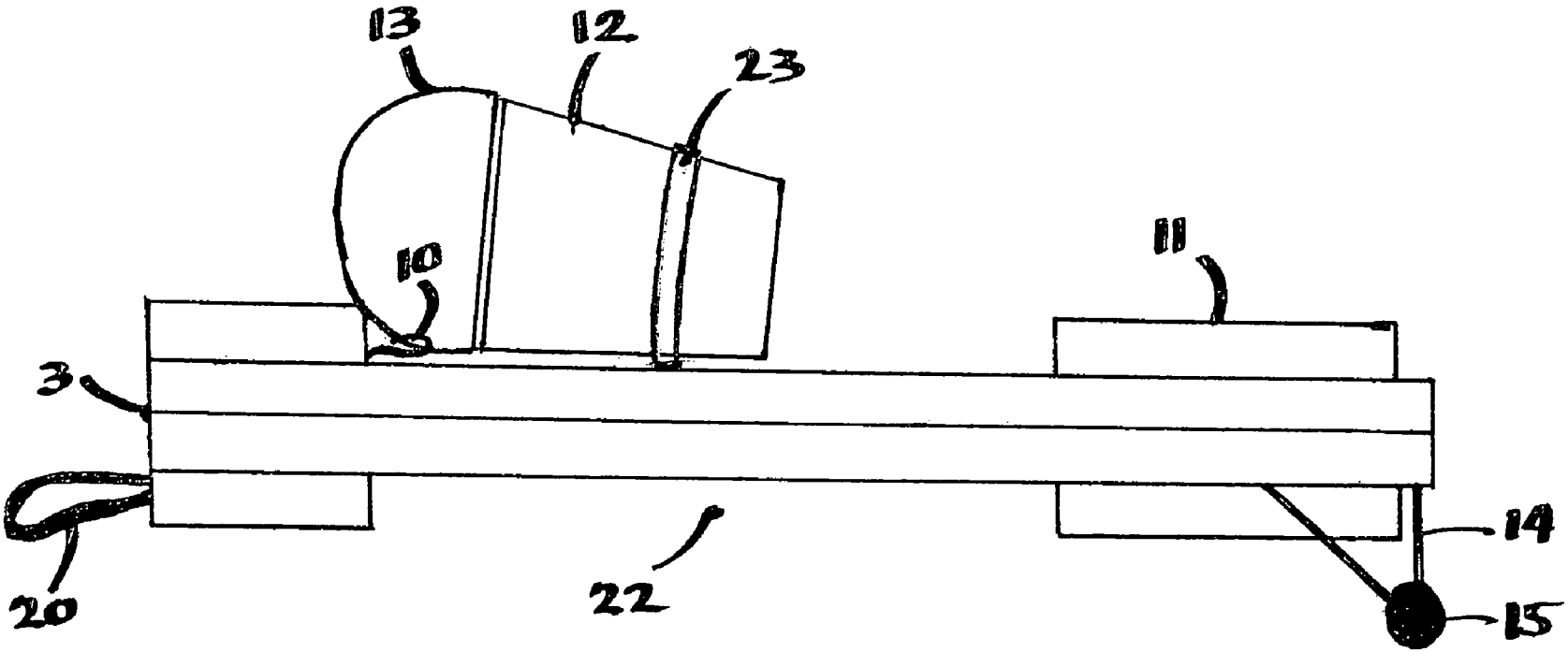
FIG. 5 is a side view along the long axis of the seating system, folded and ready for transportation.

The coupling ends 4 of these respective horizontal members 2 are preferably connected through a hinge 3 to provide an extended seating surface 16 extending along both horizontal members 2. Said coupling ends 4 also permit the two horizontal seating members 2 to be positioned such that they lie adjacent to each other for ready transportation as seen in FIG. 4.

Figure 2:
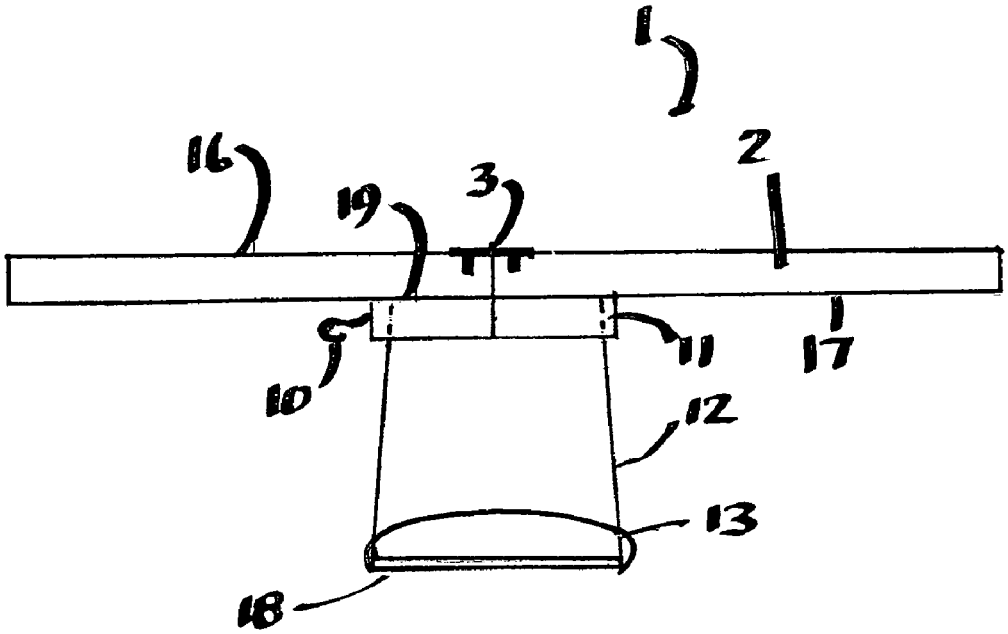
FIG. 2 is a side view along the long axis of the deployed seating system with a single central support in position.

With reference to FIG. 2, on the underside surface 17 of each horizontal seating members 2, is provided proximate to its respective coupling ends 4 with vertical support containment means 11. Such vertical support containment means 11 serve to localize the upper end of a central vertical support 12 when placed against the underside surfaces 17 of the two horizontal seating members 2, overlapping the connected coupling ends 4.

The central vertical support 12 is preferably in the shape of a hollow, truncated, right circular cone which extends from a base 18 at one end upwardly to a seat-engaging end that abuts against portions of the underside surfaces 17 of both of the horizontal seating members 2.

Figure 3:
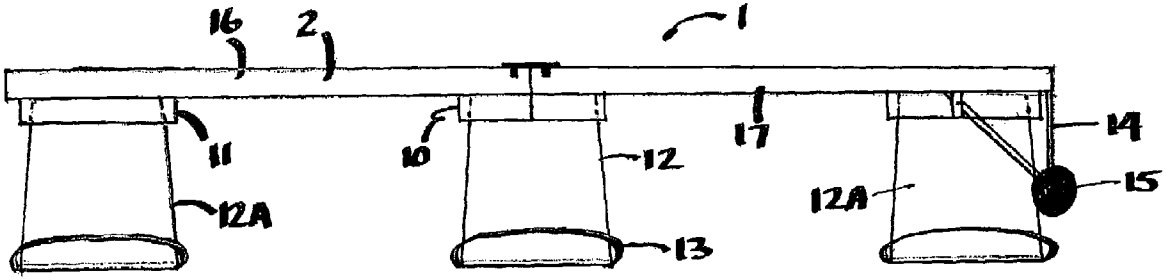

As can be seen in FIG. 3, a further preferred variant of the invention incorporates two additional vertical supports 12 to underlie further portions of the underside surfaces 17 of the horizontal seating members 2. Such additional vertical supports 12A are deployed symmetrically on either side of the central vertical support 12. According to this variant, additional vertical support containment means 11 are provided on the underside surfaces 17 of the horizontal seating members 2 to localize the additional vertical supports 12A in position when they are deployed for seating.

One of the horizontal seating members 2 is optionally provided towards one of its two ends with wheel supports 14 that extend downwardly and connect the pair of wheels 15 to the underside surface 17 at locations which will not interfere with the fitting of a vertical support member 12 in position when the seating system 1 is to serve as a seat. Such wheels 15 are not only outwardly spaced from a vertical support 12, but also extend downwardly from the underside surface 17 of the horizontal seating members 2 by an amount which is less than the height of a vertical support 12.

At the end of the horizontal seating member 2 on which the wheels 15 are installed, a strap 20 is attached to the end opposite to that which bears wheels 15, allowing the folded assembly 22 to be trailered manually. Additionally, a hook 10 may be provided on the underside of the other horizontal seating member 2 for engagement with the handles 13 of the vertical supports 12. To further fix the stacked supports 12 to the folded device 1, a nylon strap 23 with fastening ends may extend outwardly from one of the horizontal seating members 2 to embrace the assembly of vertical supports 12 and hold them in place during transportation.

CONCLUSION

The foregoing has constituted a description of specific embodiments showing how the invention may be applied and put into use. These embodiments are only exemplary. The invention in its broadest, and more specific aspects is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property of privilege is claimed are defined as follows:

1. A portable seating device comprising:

a) at least two horizontal seating members having respective coupling ends along which such members may be joined to serve as a seat, such horizontal seating members each respectively having an upper, seating, surface, and an underside surface;

b) connecting means at the coupling ends of the respective horizontal seating members by which such members may be connected to provide an extended seating surface, such connecting means permitting the two horizontal seating members to be positioned adjacent to each other for ready transportation;

c) vertical support containment means located on the underside surfaces of each respective horizontal seating member, proximate to their respective coupling ends, to localize the upper end of a central vertical support to be placed against the underside surfaces of the two horizontal seating members, overlapping their connected coupling ends, and d) a central vertical support dimensioned to be placed against the underside surfaces of the two horizontal seating members, overlapping their connected coupling ends and contained within said vertical support containment means, whereby a portable bench seating system is provided which may be deployed by placing the vertical support on the ground beneath the two horizontal seating members, aligned for engagement by the containment means on the respective underside surfaces of the horizontal seating members when such horizontal seating members are joined at their connecting ends to serve as a seat and complete the containment of the central vertical support; and wherein the central vertical support has a generally cylindrical form which extends from a base at one end upwardly to a seat-engaging end for abutting against portions of the underside surfaces of both of the horizontal seating members, in combination with a plurality of additional vertical supports dimensioned to underlie further portions of the underside surfaces of the horizontal seating members, such underside surfaces being provided with additional vertical support containment means to localize the additional vertical supports in position when they are deployed for seating.

2. A seating device as in claim 1 wherein said central vertical support has a generally circular cross-section and incorporates a degree of taper which does not interfere with its support function.

3. A seating device as in claim 1 wherein said central vertical support and the additional vertical support have a generally circular cross-section and said central vertical support and additional vertical supports all incorporate a degree of taper which does not interfere with their support function but permits such supports to be nested together for transportation and storage.

4. A seating device as in claim 1 wherein all said supports are each in the form of a tapered pail whereby such pails may be nested within each other for compact transportation.

5. A seating device as in claim 1 wherein one of the horizontal seating members is provided towards one of its two ends with wheels that extend downwardly from its underside surface at locations and to an extent which will not interfere with the fitting of a vertical support member in position when the combination is to serve as a seat.

6. A seating device as in claim 5 comprising a strap attached to one of the horizontal seating members to allow the device to be trailered manually.

7. A seating device as in claim 5 wherein said vertical supports include a handle, the underside of one of the horizontal seating members comprising a hook fastened thereon for engagement with such handles.

* * * * *